US009038341B2

(12) United States Patent
Lam et al.

(10) Patent No.: US 9,038,341 B2
(45) Date of Patent: May 26, 2015

(54) MODULAR FLOORING SYSTEM

(71) Applicant: NEWTECHWOOD, LTD., Humble, TX (US)

(72) Inventors: Richard Chorfoam Lam, Houston, TX (US); Cliff Chorsum Lam, Houston, TX (US); Terry Y. Lam, Houston, TX (US)

(73) Assignee: NEWTECHWOOD, LTD., Houston, TX (US)

( * ) Notice: Subject to any disclaimer, the term of this patent is extended or adjusted under 35 U.S.C. 154(b) by 0 days.

(21) Appl. No.: 14/301,771

(22) Filed: Jun. 11, 2014

(65) Prior Publication Data

US 2015/0096250 A1 Apr. 9, 2015

Related U.S. Application Data

(63) Continuation of application No. PCT/CN2013/086198, filed on Oct. 30, 2013.

(60) Provisional application No. 61/887,914, filed on Oct. 7, 2013.

(51) Int. Cl.

| | |
|---|---|
| ***E04F 13/08*** | (2006.01) |
| ***E04F 15/22*** | (2006.01) |
| ***E04F 15/02*** | (2006.01) |
| *E04B 5/02* | (2006.01) |
| *E04B 5/12* | (2006.01) |
| *E04B 5/43* | (2006.01) |

(52) U.S. Cl.

CPC ..... *E04F 15/225* (2013.01); *E04F 15/02044* (2013.01); *E04F 15/02038* (2013.01); *E04B 5/02* (2013.01); *E04B 5/12* (2013.01); *E04B 5/43* (2013.01)

(58) Field of Classification Search

CPC ..... E04B 5/43; E04B 5/48; E04B 5/02; E04B 5/10; E04B 5/12; E04B 5/14; E04B 13/08; E04B 15/02447; E04B 15/02458

USPC ..... 52/177, 581, 589.1, 592.1, 592.6, 381, 52/380, 403.1, 480, 481.1, 392

See application file for complete search history.

(56) References Cited

U.S. PATENT DOCUMENTS

| | | | | |
|---|---|---|---|---|
| 7,546,717 | B2 * | 6/2009 | Juan Puerta | 52/586.1 |
| 7,958,681 | B2 * | 6/2011 | Moller, Jr. | 52/181 |
| 2006/0283125 | A1 * | 12/2006 | Moller, Jr. | 52/578 |
| 2008/0127593 | A1 * | 6/2008 | Janesky | 52/581 |
| 2008/0216437 | A1 * | 9/2008 | Prevost et al. | 52/589.1 |
| 2010/0275535 | A1 * | 11/2010 | Gard et al. | 52/177 |
| 2012/0085043 | A1 * | 4/2012 | Jenkins et al. | 52/177 |
| 2012/0117910 | A1 * | 5/2012 | Chuang | 52/588.1 |
| 2014/0260061 | A1 * | 9/2014 | Knox | 52/592.1 |

* cited by examiner

*Primary Examiner* — Phi A

(74) *Attorney, Agent, or Firm* — Buskop Law Group, PC; Wendy Buskop

(57) ABSTRACT

A flooring system for installation over a surface that provides flooring using artificial wood panels over a plastic base formed from recycled plastics for even durable support over cement or dirt surfaces. The flooring system comprises a plurality of interlocking bases and a plurality of removable clips, wherein each clip has a pair of grippers for engaging at least one board of a plurality of boards, the base and clips supporting the boards apart from the surface and the plurality of boards connected between the grippers are capable of supporting a load of at least 300 pounds.

18 Claims, 6 Drawing Sheets

MODULAR FLOORING SYSTEM

CROSS REFERENCE TO RELATED APPLICATION

The present application is a Continuation of International Patent Application Ser. No. PCT/CN2013/086198 filed on Oct. 30, 2013, entitled "MODULAR FLOORING SYSTEM," and claims priority to and the benefit of U.S. Provisional Patent Application Ser. No. 61/887,914 filed on Oct. 7, 2013, entitled "MODULAR FLOORING SYSTEM." These references are hereby incorporated in their entirety.

FIELD

The present embodiments generally relate to a modular flooring system that provides flooring using artificial wood panels over a plastic base formed from recycled plastics for even durable support over a cement or dirt surface.

BACKGROUND

A need exists for a simple flooring system adapted to endure outdoor conditions, from −30 degrees Fahrenheit to 140 degrees Fahrenheit, without buckling or delaminating, and that is versatile and interchangeable to adapt quickly to different sized spaces and over different types of hard surfaces.

The present embodiments meet these needs.

BRIEF DESCRIPTION OF THE FIGURES

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a quick interlocking modular flooring system that provides flooring using artificial wood panels over a plastic base formed from recycled plastics for even durable support over a cement or dirt surface.

The present embodiments further relate to a decking or a flooring system with a plurality of interlocking bases, a plurality of clips that engage each base and a plurality of boards attachable to clips mounted to the bases.

The term "impact resistant" as used herein can refer to the ability of the base to withstand loads up to 300 pounds without deforming.

The term "semi-rigid" as used herein can refer to a bending property, wherein the base can bend up to an angle of 20 percent from a base plane without breaking.

A benefit of this invention is that the system is modular, quick and easy to install, take apart, and rebuild if a portion becomes broken.

The flooring system is for installation over a hard surface and can be made using a plurality of interlocking impact resistant semi-rigid bases. In embodiments, each impact resistant, semi-rigid base can be a one piece structure.

Figure 1:
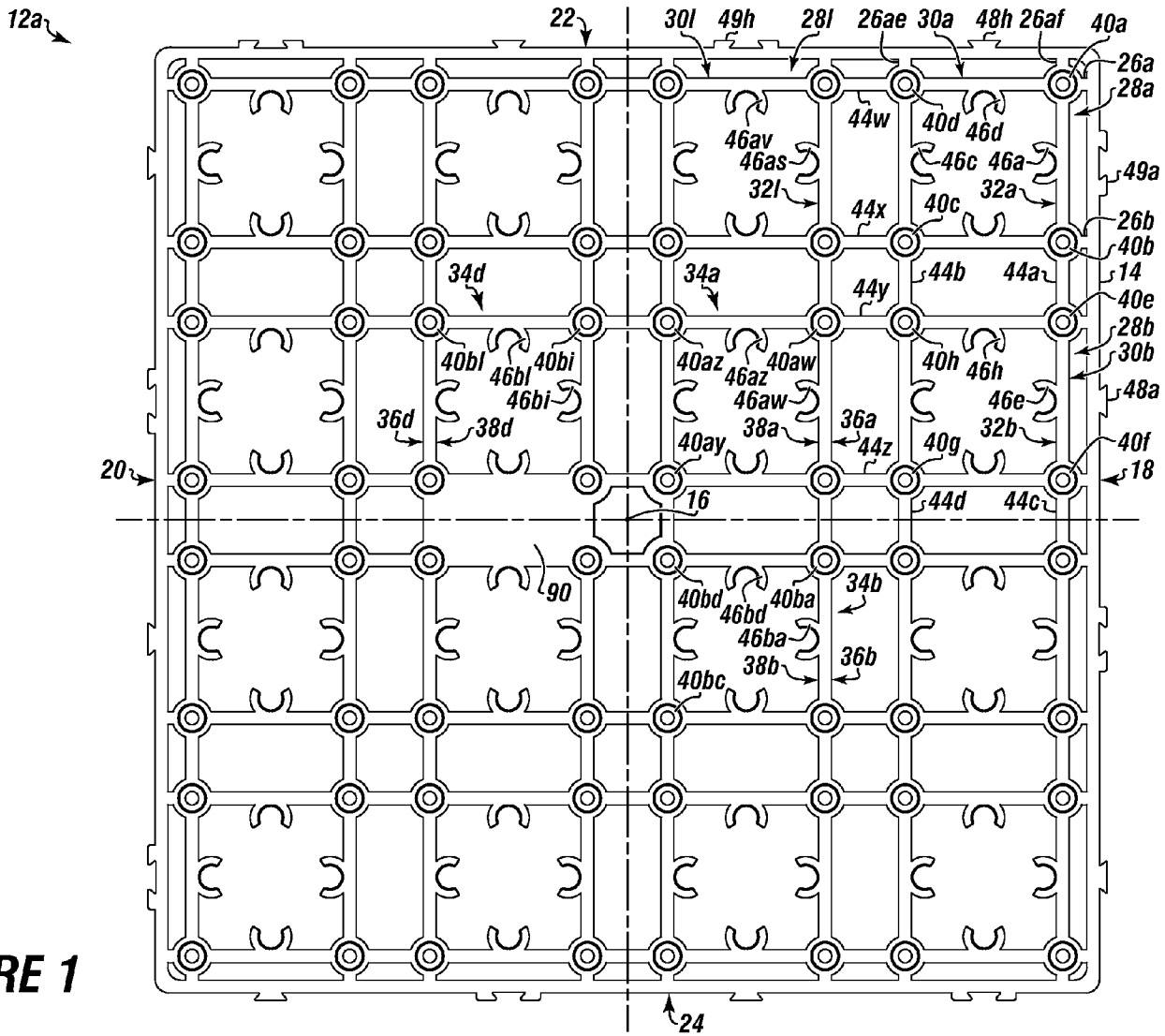
FIG. 1 is a top view of one of the interlocking impact resistant semi-rigid base of the system.

Turning now to the Figures, FIG. 1 is a top view of one of the interlocking impact resistant semi-rigid bases 12*a*.

The interlocking impact resistant semi-rigid base 12*a* can be molded or pressure formed into a shape that has a frame 14 with a center point 16, a first side 18 opposite a second side 20, and a third side 22 opposite a fourth side 24 positioned around the center point.

In one or more embodiments, the interlocking impact resistant semi-rigid base can be a one piece structure.

The third and fourth sides can be connected to and formed between the first and second sides, wherein the frame is formed in a frame plane.

A plurality of spacers 26*a*-26*af* can extend from the frame towards the center point.

Each spacer extending from the frame towards the center point can be made from the same material as the frame, such as a flexible plastic or plastic mixed with rubber.

The frame can be made from recycled plastic milk bottles, such as polyethylene or polypropylene. The base can be made from alpha olefin homopolymers, or blends of alpha olefin homopolymers with copolymers. The base can be made from copolymers of alpha olefins that are crosslinked or covalently linked.

A plurality of outer squares 28*a*-28*l* can be attached to the spacer within the frame. Each outer square can have an open central area.

Each outer square can have an outer perimeter and an inner perimeter. The outer perimeters 30*a*-30*l* are depicted as the outside of each outer square. The inner perimeters 32*a*-32*l* are depicted on the inside of each outer square.

A plurality of tubes 40*a*-40*bl* can be formed at each corner of each outer square. One outer square can have four tubes. The tubes can have an inner diameter of 0.5 inches.

The outer square 28*a* can have tubes 40*a*-40*d* and the outer square 28*b* can have tubes 40*e*-40*h*.

Each outer square can have the same number of tubes formed at the corners of the outer square.

A plurality of support members 44*a*-44*z* can be used. One to four support members can extend from each tube.

The outer square 28*a* has tube 40*d* with support member 44*w* extending from it towards a tube of outer square 281.

The outer square 28*a* has tube 40*c* with support member 44*x* extending from it towards a tube of outer square 281 that is different from the tube to which support member 44*w* connects.

The outer square 28*b* has a tube 40*h* with a support member 44*y* extending towards a tube 40*aw* of an inner square labeled as 34*a*.

The outer square 28*b* has a tube 40*g* with a support member 44*z* extending from it in parallel to support member 44*y* towards a different tube of the same inner square 34*a*.

In embodiments, the outer squares are not solid and can have open centers and can be configured to be suggestive of a square frame.

A plurality of inner squares can be used. Inner squares 34*a*, 34*b*, and 34*d* are labeled.

Each inner square can have an inner square outer perimeter 36*a*, 36*b*, and 36*d* and an inner square inner perimeter 38*a*, 38*b*, and 38*d*.

The inner square 34*a* has inner square outer perimeter 36*a* and inner square inner perimeter 38*a*. The inner square 34*a* has tubes 40*az*, 40*ay*, and 40*aw*.

The inner square 34*b* has inner square outer perimeter 36*b* and inner square inner perimeter 38*b*. The inner square 34*b* has tubes 40*ba*, 40*bd*, and 40*bc*.

The inner square 34*d* has inner square outer perimeter 36*d* and inner square inner perimeter 38*d*. The inner square 34*d* has tubes 40*bl* and 40*bi*.

The support members in this system can connect a tube from an outer square to an outer square, a tube from an outer square to an inner square, and between tubes of the inner squares.

Spacers can connect from a tube of one square to a tube of an adjacent square.

A plurality of hooks can be secured to each inner perimeter of each outer square and each inner square. In embodiments, the hooks can be C-shaped.

The hooks formed in a C-shape, can be secured to the inner perimeter of each square with each hook being secured at a midpoint of the hook, with the open ends of the C-shape all oriented towards a center of the square Outer square 28*a* has hooks 46*a*, 46*c* and 46*d* are labeled. Outer square 28*b* has hooks 46*e* and 46*h* labeled. Outer square 28*l* has hooks 46*as* and 46*av* labeled.

Inner square 34*a* has hooks 46*aw* and 46*az* labeled. Inner square 34*b* has hooks 46*ba* and 46*bd* labeled. Inner square 34*d* has hooks 46*bi* and 46*bl* labeled.

In this Figure, four hooks are depicted in the outer and inner square, but are not labeled In embodiments, from 2 hooks to 8 hooks can be used per inner perimeter of each square.

In embodiments, one hook can be used on each side of a square.

In embodiments, the hooks can be mounted in at least two of the four corners of one or all of the squares.

A plurality of male locking means 48*a*-48*h* and a plurality of female locking means 49*a*-49*h* are shown formed on each side of the frame opposite the plurality of spacers.

The male and female locking means are in a spaced apart relationship from each other on a side of the frame.

Also shown is a first message board 90. The message board can support printed text or contain embossed text, images, logos or an emergency message.

Figure 2:
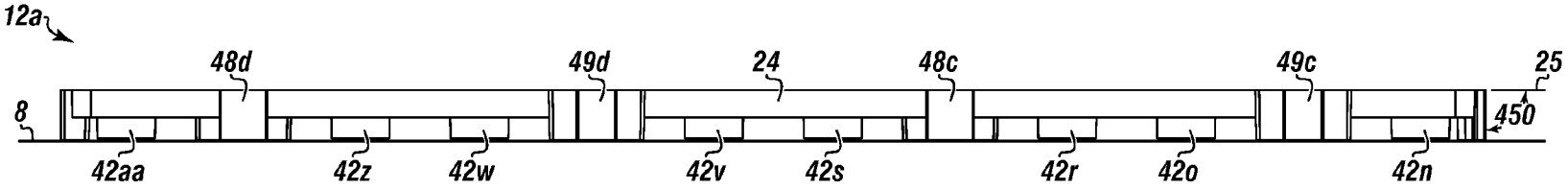
FIG. 2 is a side view of the interlocking impact resistant semi-rigid base.

FIG. 2 is a side view of the interlocking impact resistant semi-rigid base.

In this Figure, the interlocking impact resistant semi-rigid base 12*a* is shown with the fourth side 24 of the frame.

Each of the plurality of tubes can have foot portions 42*n*-42*aa* extending at an angle 450 from 70 degrees to 100 degrees from a frame plane 25. In embodiments, the foot portion can extend at 90 degrees from the frame plane 25 on a side opposite the side shown in FIG. 1.

The foot portions can support the frame apart from a surface 8.

In this side view, male locking means 48*c* and 48*d* and female locking means 49*c* and 49*d* can be seen. The locking means can be configured to receive opposing locking means from another interlocking impact resistant semi-ridge base.

Figure 3:
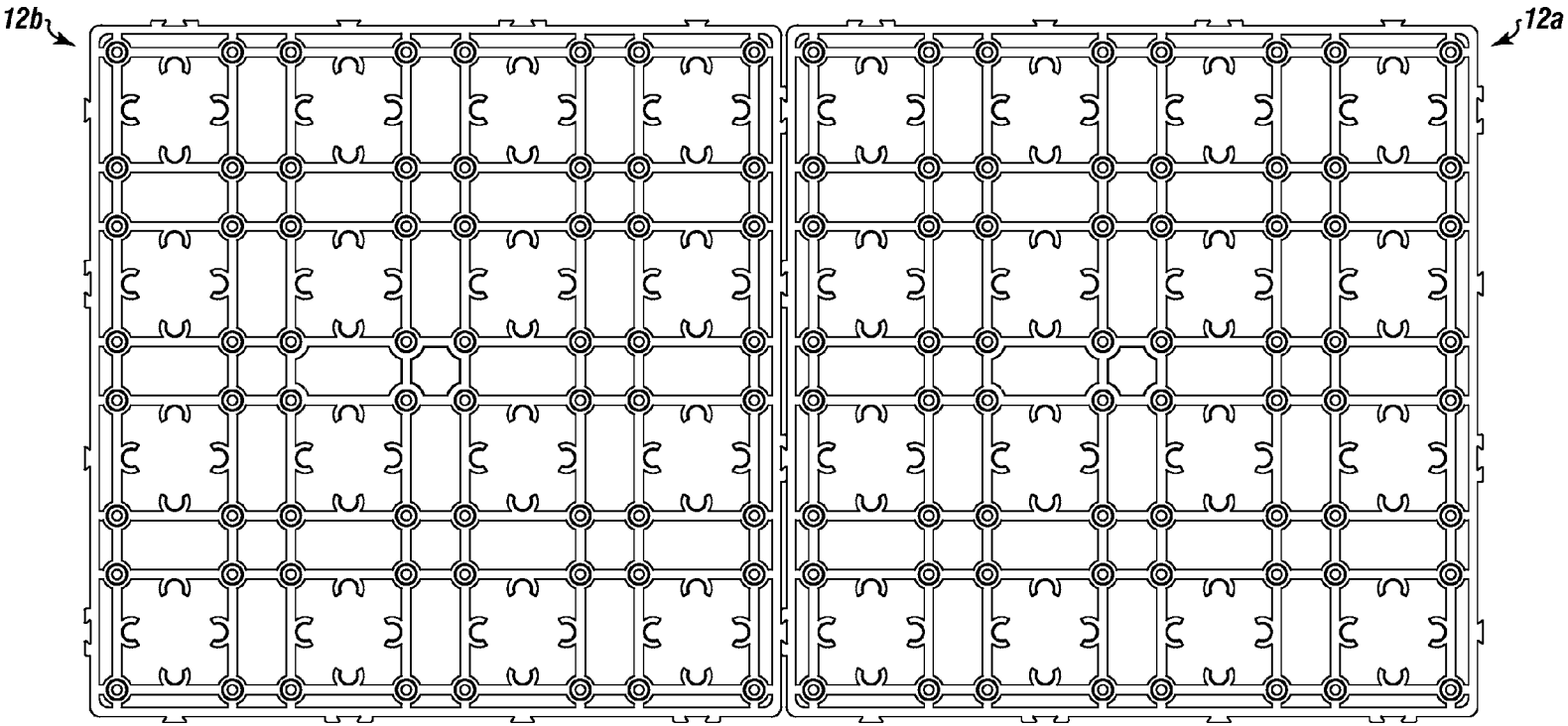
FIG. 3 is a top view of two interlocking impact resistant semi-rigid bases according to the embodiments.

FIG. 3 is a top view of two interlocking impact resistant semi-rigid bases according to the embodiments.

Interlocking impact resistant semi-rigid base 12*b* is shown interlocking with interlocking impact resistant semi-rigid base 12*a*. In this example, the interlocking impact resistant semi-rigid base 12*b* uses its male locking means to engage the female locking means of interlocking impact resistant semi-rigid base 12*a*. Interlocking impact resistant semi-rigid base 12*b* simultaneously uses its female locking means to engage male locking means of interlocking impact resistant semi-rigid base 12*a*. This secure interlock enables the system to be highly durable.

Figure 4:
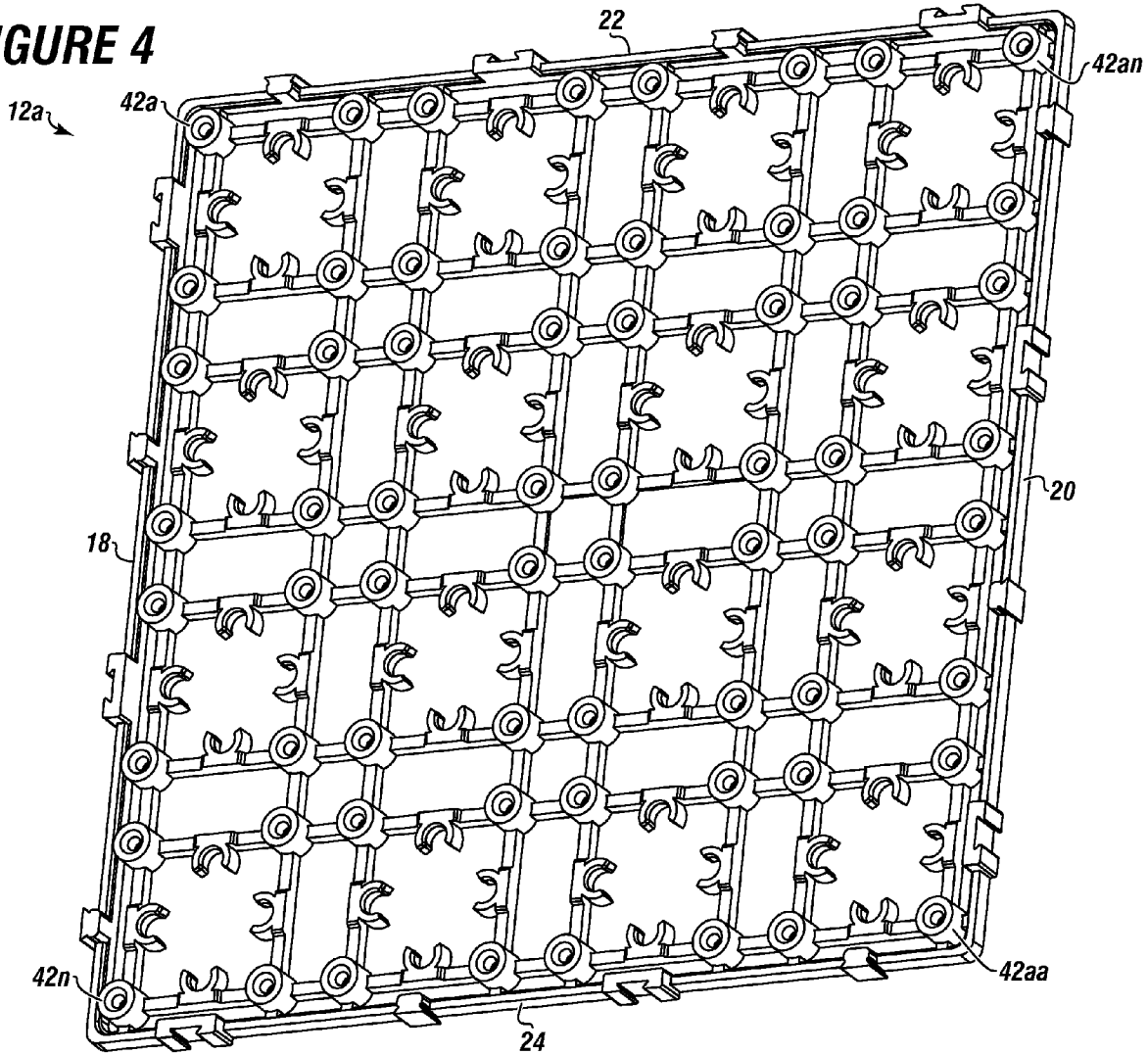
FIG. 4 is a bottom view of the interlocking impact resistant semi-rigid base.

FIG. 4 is a bottom view of the interlocking impact resistant semi-rigid base.

The interlocking impact resistant semi-rigid base 12*a* can have foot portions 42*a*-42*an*. The first side 18, the second side 20, the third side 22 and the fourth side 24 are also shown.

Figure 6:
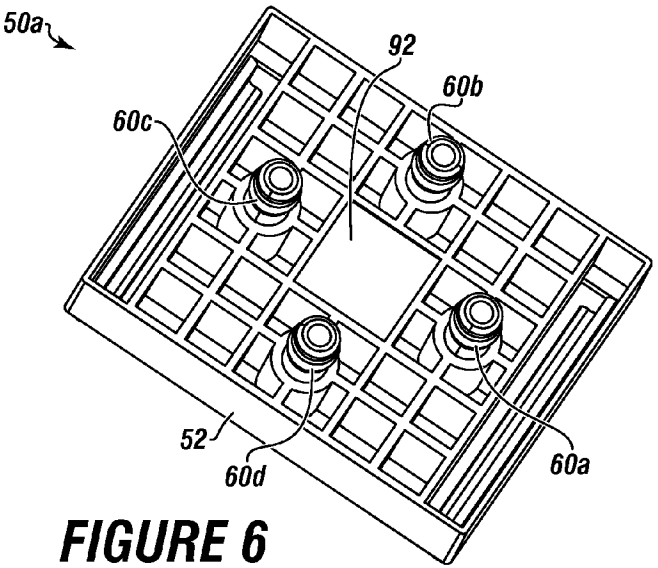
FIG. 6 is a bottom view of a removable clip usable in the system.
Figure 5:
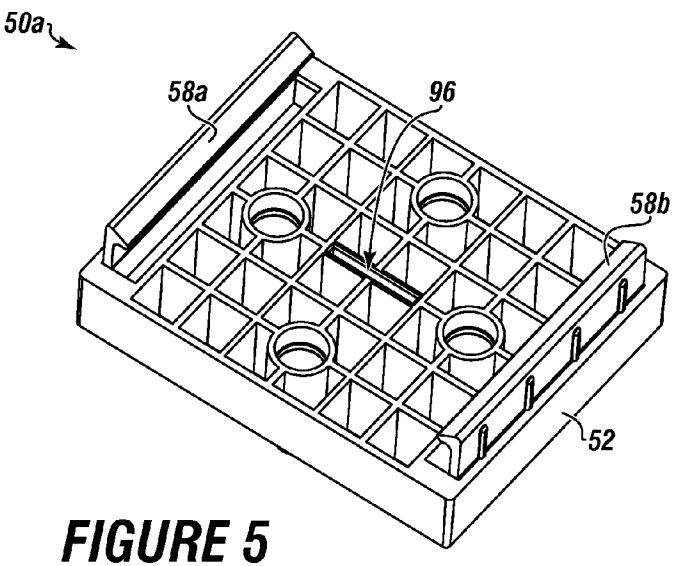
FIG. 5 is a top view of a removable clip usable in the system.
Figure 7:
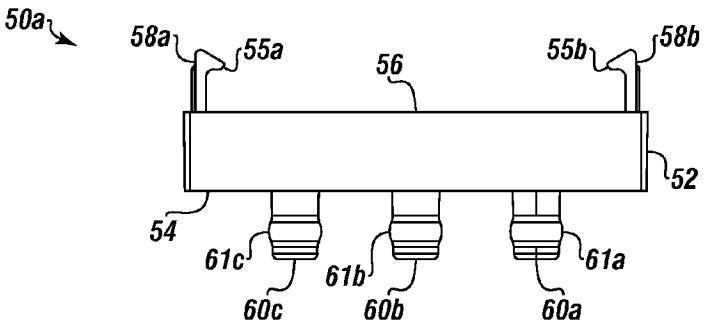
FIG. 7 is a side view of a removable clip usable in the system.

FIG. 5 is a top view of a removable clip usable in the system. FIG. 6 is a bottom view of a removable clip usable in the system. FIG. 7 is a side view of a removable clip usable in the system.

The removable clip 50*a* can be used to connect the interlocking impact resistant semi-rigid bases.

The removable clip 50*a* can have a clip base 52.

In the top and side views, a pair of grippers 58*a* and 58*b* is shown. Each gripper can extend from the top side 56 of the clip base 52. The first gripper 58*a* can attach to the clip base 52 on a side opposite a second gripper 58*b*.

The pair of grippers 58*a* and 58*b* can each have a lip 55*a* and 55*b* for securing a single board to the removable clip 50*a*.

In one or more embodiments, the lips of the pair of grippers can face each other.

The removable clip 50*a* has a plurality of connecting rods 60*a*, 60*b*, 60*c* and 60*d* extending from the clip base 52 on the bottom side 54.

Each connecting rod can have a ridge. Ridge 61*a* is on rod 60*a*, ridge 61*b* is on rod 60*b*, and ridge 61*c* is on rod 60*c* for locking into or engaging one of the hooks.

A second message board 92 can be formed in the clip base 52. The message board can support printed text or contain embossed text, images, logos or an emergency message.

Also shown is a slot 96 which can receive a device for providing a penetrating grip into a board held by the grippers of a clip attached to a base.

Figure 8:
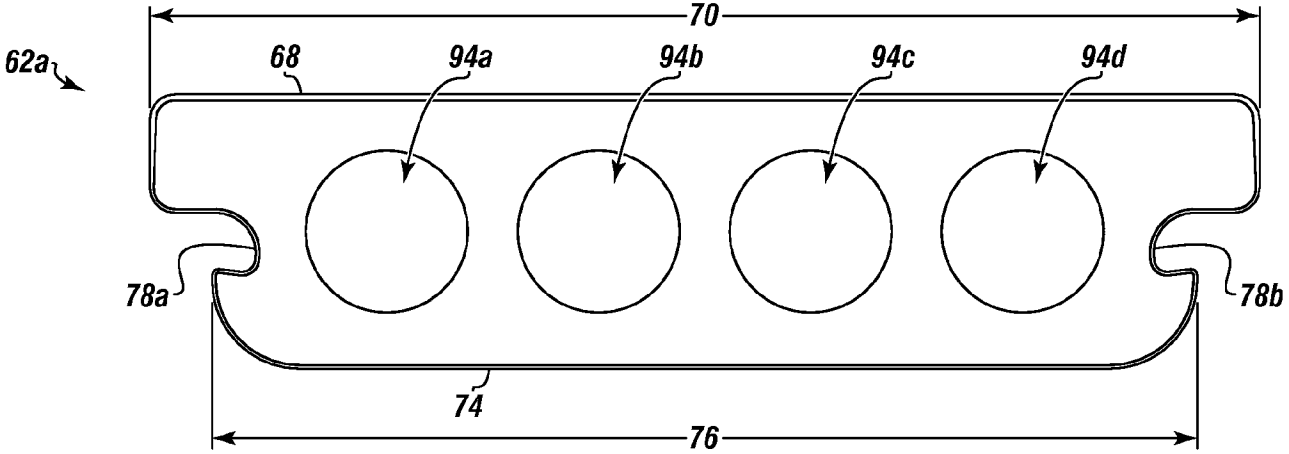
FIG. 8 is an end view of a board according to the embodiments.

FIG. 8 is an end view of a board from the plurality of boards according to the embodiments.

The outdoor flooring or decking system can include a plurality of boards. In embodiments, each board of the system can have an identical length.

Each board can be formed to slide within the grippers of a clip for a secure engagement with the clip while the clip is engaged with the base.

In this embodiment, each board 62*a* of the plurality of boards can have a board top 68 with a first width 70 and a board bottom 74 with a second width 76. The second width can be at least 10 percent less than the first width.

A first groove 78*a* can be formed on one side of the board between the board top 68 and the board bottom 74. A second groove 78*b* can be formed on the opposite side of the board between the board top and the board bottom.

Each groove can extend the length of the board for engagement with the pair of grippers.

Board holes 94*a*-94*d* can be formed in the board 62*a* extending the entire length of the board without penetrating the groove, board top or board bottom.

Figure 9:
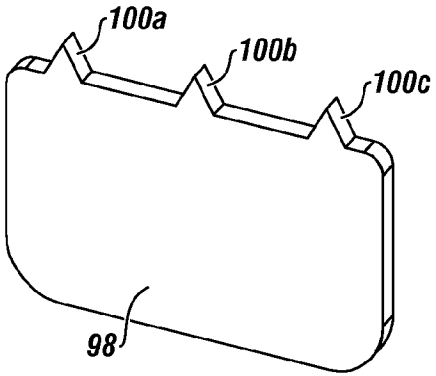
FIG. 9 is side view of a fang securing mechanism according to the embodiments.

FIG. 9 is side view of a fang securing mechanism according to the embodiments.

The fang securing mechanism 98 can be removably inserted into the slot shown in FIG. 5. Fangs 100*a*-100*c* can penetrate the board when a load is applied to the board, which can be up to 1000 pounds.

The fang securing mechanism can have a thickness from 0.2 millimeters to 0.4 millimeters and a length from 1 millimeter to 4 millimeters.

Figure 10:
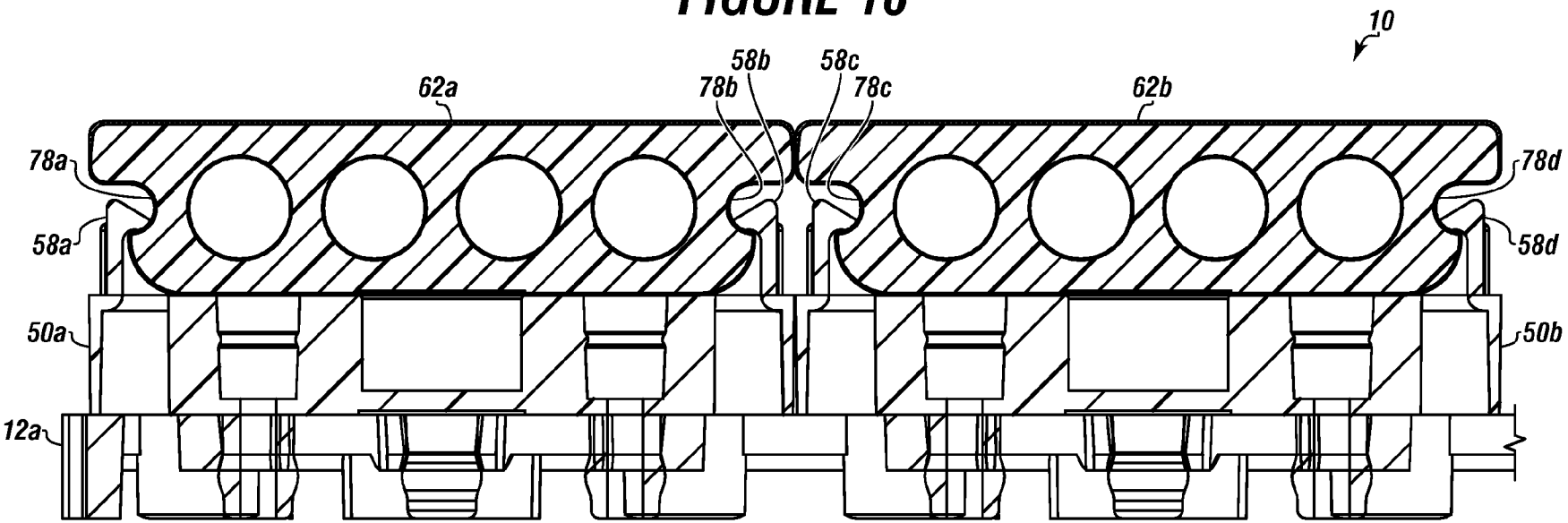
FIG. 10 is a detail cut view of a portion of the interlocking impact resistant semi-rigid base with clips and boards attached forming the flooring system.

FIG. 10 shows a portion of the interlocking impact resistant semi-rigid base with clips and boards attached forming the flooring system.

The flooring system 10 is shown over one interlocking impact resistant semi-rigid base 12*a* supporting two removable clips 50*a* and 50*b*, with each removable clip supporting a single board 62*a* and 62*b*. The pair of grippers 58*a* and 58*b* can hold board 62*a* to the removable clip 50*a* by engaging each groove 78*a* and 78*b* of the board 62*a*.

The pair of grippers 58*c* and 58*d* can hold board 62*b* to the removable clip 50*b* by engaging each groove 78*c* and 78*d* of the board 62*b*.

In embodiments, the spacers can have a length from 0.05 inches to 0.125 inches.

In embodiments, the spacers and the squares can be formed from an identical material as the frame.

In embodiments, the base can be a molded component with an ability to withstand temperatures from −30 degrees Fahrenheit to 150 degrees Fahrenheit without breaking.

In embodiments, from 1 spacer to 32 spacers can be connected to the frame and extend toward the center point in the frame.

In embodiments, the surface can be concrete, hard packed dirt, or another even, solid surface.

In embodiments, from 2 support members to 8 support members can extend from each outer perimeter of each square.

In embodiments, a first message board can be formed in the base as shown in FIG. 1.

In embodiments, a second message board can be formed in the removable clip base as shown in FIG. 6.

In embodiments, the connecting rods can be oriented in a diamond pattern to enable orientation of the boards in two directions. The connecting rods can be separated by an angle from 80 degrees to 120 degrees.

In embodiments, 2 male locking means and 2 female locking means can be used per side of the frame.

In embodiments, from 4 removable clips to 16 removable clips per base can be used.

While these embodiments have been described with emphasis on the embodiments, it should be understood that within the scope of the appended claims, the embodiments might be practiced other than as specifically described herein.

What is claimed is:

1. A flooring system for installation over a surface comprising:

a. a plurality of interlocking impact resistant semi-rigid bases, each interlocking impact resistant semi-rigid base comprising:

(i) a frame with a center point, a first side opposite a second side, and a third side opposite a fourth side positioned around the center point, with the third side and the fourth side connected to and formed between the first and second sides, and wherein the frame is formed in a frame plane;

(ii) a plurality of spacers, each spacer extending from the frame towards the center point;

(iii) a plurality of outer squares, each outer square having an outer perimeter and an inner perimeter;

(iv) a plurality of inner squares, each inner square having an inner square outer perimeter and an inner square inner perimeter;

(v) a plurality of tubes formed at each corner of each square, each tube having a foot portion extending at an angle 90 degrees from the frame plane, wherein the foot portion supports the frame apart from the surface, and wherein two tubes of each outer square connect to at least one spacer;

(vi) a plurality of support members, each support member connecting a tube from a square to a tube of an adjacent square;

(vii) a plurality of hooks secured to each inner perimeter of each outer square and each inner square; and (viii) a male locking means and a female locking means formed on each side of the frame opposite the plurality of spacers, wherein the male locking means and the female locking means are in a spaced apart relationship from each other on a side;

b. a plurality of removable clips for connecting to one of the plurality of interlocking impact resistant semi-rigid bases, each removable clip comprising:

(i) a clip base with a bottom side and a top side;

(ii) a pair of grippers, each gripper extending from the top side of the clip base, wherein a first gripper attaches to the clip base on a side opposite a second gripper; and (iii) a plurality of connecting rods extending from the bottom side of the clip base, each connecting rod configured to engage one of the hooks; and c. a plurality of boards, each board having identical lengths, each board formed to slide within the pair of grippers for a secure engagement while the removable clip is engaged with at least one of the plurality of interlocking impact resistant semi-rigid bases, each board comprising:

(i) a board top having a first width;

(ii) a board bottom having a second width, wherein the second width is at least 10 percent less than the first width; and (iii) a first groove formed between the board top and the board bottom, on a first side, and a second groove formed between the board top and the board bottom on an opposite side of the board, wherein each groove extends the length of the board for engagement with the pair of grippers.

2. The flooring system of claim 1, wherein each spacer has a length from 0.05 inches to 0.125 inches.

3. The flooring system of claim 1, wherein the spacers and the squares are formed from an identical material as the frame.

4. The flooring system of claim 1, wherein each of the interlocking impact resistant semi-rigid bases is a molded component with an ability to withstand temperatures from 0 degrees Fahrenheit to 120 degrees Fahrenheit without breaking.

5. The flooring system of claim 1, wherein the frame comprises from 1 spacer to 32 spacers extending toward the center point in the frame.

6. The flooring system of claim 1, wherein the plurality of hooks are formed in a C-shape, and wherein each C-shaped hook is secured to the inner perimeter of the squares and each hook is secured at a midpoint of the hook.

7. The flooring system of claim 1, comprising from 2 to 8 hooks per inner perimeter of each square.

8. The flooring system of claim 1, wherein each connecting rod of the clip base comprises a ridge for locking into one of the hooks.

9. The flooring system of claim 1, wherein the surface is concrete, a hard packed dirt, or another even solid surface.

10. The flooring system of claim 1, comprising from 2 support members to 8 support members extending from each outer perimeter of each square.

11. The flooring system of claim 1, further comprising a first message board formed in the interlocking impact resistant semi-rigid base.

12. The flooring system of claim 1, further comprising a second message board formed in the clip base.

13. The flooring system of claim 1, wherein the connecting rods are formed in a diamond pattern to enable orientation of the boards in two directions separated by an angle of from 10 degrees to 45 degrees.

14. The flooring system of claim 1, further comprising a plurality of board holes formed in the boards extending the length of the boards without penetrating the groove, the board top, or the board bottom.

15. The flooring system of claim 1, comprising a slot formed in the clip base and a fang securing mechanism removably insertable into the slot, wherein the fang securing mechanism has fangs for penetrating the board when a load is applied to the board.

16. The flooring system of claim 1, comprising 2 male locking means and 2 female locking means per side of the frame.

17. The flooring system of claim 1, comprising 4 removable clips to 16 removable clips per interlocking impact resistant semi-rigid bases.

18. The flooring system of claim 1, wherein each gripper has a lip for securing the board to the removable clip and wherein the lips of the pair of grippers face each other.

* * * * *